US008381554B2

(12) United States Patent
Senn

(10) Patent No.: US 8,381,554 B2
(45) Date of Patent: Feb. 26, 2013

(54) LOCK-PROTECTING HASP APPARATUS

(75) Inventor: Brian A. Senn, South Milwaukee, WI (US)

(73) Assignee: Powerbrace Corporation, Kenosha, WI (US)

( * ) Notice: Subject to any disclaimer, the term of this patent is extended or adjusted under 35 U.S.C. 154(b) by 40 days.

(21) Appl. No.: 13/065,512

(22) Filed: Mar. 23, 2011

(65) Prior Publication Data

US 2012/0240642 A1 Sep. 27, 2012

(51) Int. Cl.
*E05B 67/38* (2006.01)

(52) U.S. Cl. ..... 70/56; 70/2; 292/281

(58) Field of Classification Search ..... 70/2–13, 70/32–34, 54–56; 292/281–287
See application file for complete search history.

(56) References Cited

U.S. PATENT DOCUMENTS

| | | | | |
|---|---|---|---|---|
| 3,736,016 | A | 5/1973 | Garvey et al. | |
| 3,744,280 | A | 7/1973 | Brown, Jr. et al. | |
| 3,759,557 | A | 9/1973 | Athas | |
| 3,996,774 | A | 12/1976 | Best | |
| 4,324,426 | A * | 4/1982 | Michelson | 292/281 |
| 4,581,907 | A | 4/1986 | Eberly | |
| 4,640,109 | A * | 2/1987 | Schaublin et al. | 70/202 |
| 4,745,783 | A | 5/1988 | Poe | |
| 4,788,836 | A | 12/1988 | Poe | |
| 4,949,560 | A | 8/1990 | Anderson | |
| 4,961,329 | A | 10/1990 | Anderson | |
| 5,174,135 | A | 12/1992 | Longhlin | |
| 6,591,641 | B1 * | 7/2003 | Cann | 70/14 |
| 7,234,755 | B1 | 6/2007 | Senn | |
| 8,056,945 | B2 * | 11/2011 | Moreno | 292/321 |
| 2010/0253098 | A1 * | 10/2010 | Moreno | 292/321 |

OTHER PUBLICATIONS

Web archive of www.powerbrace.com/security.html dated May 9, 2008. http://web.archive.org/web/20080509161844/http://www.powerbrace.com/security.html.*

* cited by examiner

*Primary Examiner* — Suzanne Barrett
*Assistant Examiner* — Richard G Davis
(74) *Attorney, Agent, or Firm* — Law Office of John W. Harbst

(57) ABSTRACT

A lock-protecting hasp apparatus for use on a container having a door movable between closed and open positions and including a first hasp, mounted to an exterior surface of the door, and a second hasp. Each hasp has a mounting portion and a hasp portion connected to and extending away from the mounting portion of the respective hasp. Each hasp portion defines openings for accepting and accommodating a shackle of a lock. Each hasp further includes a shackle guard secured to and extending generally coextensive with the hasp portion of each hasp. Each shackle guard also defines openings to allow the lock shackle to pass therethrough and secure the hasps to each other. A lengthwise portion of each shackle guard vertically extends beyond the hasp portion of each hasp and defines a third opening for accommodating a security seal passing therethrough.

21 Claims, 4 Drawing Sheets

LOCK-PROTECTING HASP APPARATUS

FIELD OF THE INVENTION DISCLOSURE

This invention disclosure generally relates to shipping containers, and more specifically, to a lock-protecting apparatus including two hasps capable of visually indicating whether a movable door of a shipping container has been moved from a closed position.

BACKGROUND OF THE INVENTION DISCLOSURE

Intermodal cargo freight containers and semi-trailer containers (hereinafter collectively referred to as "containers) provide an economic mode for transporting large quantities of cargo or goods between distant locations. Such containers are stacked on ships, carried on railcars, and are typically moved to various geographically spaced locations. The United States freight transportation network commonly uses cargo or freight containers to move a staggering volume of goods each year. In just the last year, tens of millions of containers entered the United States through water and land ports. In just the last year, approximately 20 billion tons of goods, worth in excess of $10 trillion, were moved into and around the United States. This translates into several hundreds of pounds of freight moved daily for each and every U.S. resident.

A typical freight container includes a box-like enclosure having an open end for loading and unloading goods. A pair of swing-out doors, mounted in a rigid container frame, close the open end of the cargo container during transport. Each door is hingedly secured to the door frame along one vertical edge thereof. In many applications, an exterior of each door is provided with a bar lock assembly including a vertically elongated locking rod. Rotation of the locking rod allows cam structures of the locking rod to cooperate with other conventional instrumentalities on the door frame to secure the respective container door in a closed position.

Coupled with the immense volume of goods being shipped is the exposure to enormous risks. One of the most prevalent and so called "victimless" crimes involves cargo theft. Worldwide industry theft losses for cargo in 1995 were approximated at $470 billion. Between hijackings and internal fraud, the costs to business has reached epidemic proportions. As a consequence, insurance premiums and deductibles are rising at an alarming rate. While insurance payouts can replace such stolen goods, the loss of business from clients forced to buy replacement goods might never be replaced. Companies simply cannot continue to afford to pay the exorbitant price tag involved with having their cargos stolen, ranging from the actual value of the goods, to business downtime, to the loss of opportunities to market and sell seasonable goods, to the total loss of product sales. Even though enforcement agencies have begun forming task forces to deal with cargo theft problems, most of their responses have been reactive rather than proactive. Accordingly, law enforcement agencies and private industry have realized they must work together to find a solution to the problem of cargo theft.

Heretofore, a very basic procedure at inhibiting cargo theft involves locking the doors on the cargo containers. In one form, the locking rods on the doors of the cargo container are configured to permit a padlock or other suitable locking device to be arranged on the outside of the container to prevent rotation of the locking rod. Of course, if the locking rod cannot be rotated, opening of the doors is prevented.

After removing such cargo containers from the ships, they are often placed upon the ground in remote storage areas prior to being loaded on trucks or railcars. The remoteness of such cargo container storage presents a prime opportunity for cargo theft. Another prime opportunity for cargo theft is when a railcar carrying cargo containers is parked on a secluded siding or switching yard. Such areas are vulnerable to having conventional padlocks being cut with bolt cutters or a pry bar without drawing particular attention to such acts. Furthermore, if a theft of cargo does occur in either a storage area, secluded siding or switching yard, or even when the trucker driving the truck used to transport the container between locations it is not present, it is possible for such theft not to be discovered for an extended time period.

Thus, there is a need and continuing desire for a lock-protecting hasp apparatus which is simple, versatile, and embodies enhanced protection from the more common methods of forced attack while structured to accommodate a security seal for providing an easily viewed indication of whether a movable door of the shipping container has been moved from a closed position.

SUMMARY OF THE INVENTION DISCLOSURE

In view of the above, and in accordance with one aspect, there is provided a lock-protecting hasp apparatus for use on a container having a door movable between closed and open positions. The lock-protecting hasp apparatus includes a first hasp, mounted to an exterior surface of the door, and a second hasp. Each hasp has a mounting portion and a hasp portion connected to and extending away from the mounting portion of the respective hasp. The hasp portion of each hasp has a predetermined height.

With the door in the closed position, the hasp plate portions of the first and second hasps are arranged to project generally coextensive relative to each other. Each hasp portion defines two openings for accepting and accommodating a shackle of a lock. Each hasp further includes a shackle guard secured to and extending generally coextensive with the hasp portion of each hasp. Each shackle guard defines two openings which generally align with the two openings in the hasp portion of each hasp such that when the hasp portions of the first and second hasps are arranged in generally coextensive relation relative to each other, the shackle of the lock is permitted to pass therethrough so as to secure the hasps to each other and thereby maintain the door in the closed position.

The shackle guard projects beyond the predetermined height of the hasp portion of each hasp and defines a third opening, arranged in spaced vertical relation from a marginal edge of the hasp portion. The third opening in the shackle guard accommodates a security seal passing therethrough. The security seal provides an instant visual image whether the door has been moved from the closed position.

Preferably, the openings in the hasp portion of each hasp have a keyhole configuration providing for rotation of the shackle of the lock relative to the hasp. In one form, the openings in the hasp portion of each hasp and the openings in the shackle guard are substantially similar in configuration relative to each other.

The third opening defined by the shackle guard preferably has an elongated configuration. In one embodiment, a marginal edge of the third opening defined by the shackle guard has an inner diameter smaller than the inner diameter keyhole configuration of the openings defined by either the hasp portion or the shackle guard. In one form, the container has a second door cooperable with the first door, with the second hasp being mounted to the second door.

According to another aspect, there is provided a lock-protecting hasp apparatus for maintaining first and second container doors in secured relationship relative to each other. Each container door is movable between closed and open positions. According to this aspect, the lock-protecting hasp apparatus includes a pair of complemental hasps including, respectively, a hasp portion having upper and lower marginal edges defining a predetermined height of the hasp portion and with each hasp portion defining first and second vertically elongated openings for receiving a padlock shackle having a pair of interconnected shackle legs. Each hasp further includes an elongated mounting portion secured to and extending away from the hasp portion for fixedly mounting the hasps to the doors in adjacent relation relative to each other and such that the hasp portions are arranged in proximate and confronting relation to each other when the doors are in their closed position whereby permitting the padlock shackle to pass through the openings in the hasp portions of the respective hasps so as to lock the doors together.

According to this aspect, each hasp further includes a shackle guard secured to and extending generally coextensive with the hasp portion of each hasp. Each shackle guard defines two vertically elongated openings which align with the two openings in the hasp portion of each hasp such that the padlock shackle is permitted to pass therethrough. The shackle guard of each hasp projects beyond the predetermined height of the hasp portion and defines a third opening. The third opening in the shackle guard is arranged in spaced vertical relation from a marginal edge of the hasp portion and accommodates a security seal passing therethrough and so as to allow the security seal to provide an instant visual image whether either container door has been moved from the closed position.

Preferably, the openings of each hasp portion have a keyhole configuration providing for rotation of the shackle of the lock relative to the hasp. In a preferred form, the elongated openings in the hasp portion of each hasp and the elongated openings in the shackle guard are substantially similar in configuration relative to each other.

The third opening defined by the shackle guard preferably has a vertically elongated configuration. In one form, a marginal edge of the third opening defined by the shackle guard has an inner diameter smaller than the inner diameters of the openings defined by either the hasp portion or the shackle guard.

According to another aspect of this invention disclosure, there is provided a lock-protecting hasp apparatus for maintaining first and second container doors in secured relationship relative to each other. Each door is movable from a closed position to an open position. According to this aspect, the lock-protecting hasp apparatus includes a pair of complemental hasps including, respectively, a longitudinally elongated portion with a mounting section defining a plurality of mounting bolt holes. The longitudinally elongated portion of each hasp has spaced first and second generally parallel marginal edges. The longitudinally elongated portion of each hasp also has an angled section connected to and angled slightly relative to the mounting section. Each hasp further has a hasp portion having generally the same predetermined height as and extends away from an end region of the angled section of the respective hasp. The hasp portions of the pair of hasps are arranged, when the doors are in the closed position, to project generally coextensive relative to each other.

According to this aspect, the hasp portion of each hasp defines two vertically elongated openings for accepting and accommodating a shackle of a lock. Each hasp further includes a shackle guard secured to and extending generally coextensive with the hasp portion of each hasp. Each shackle guard defines two vertically elongated openings which are aligned with the two openings in the hasp portion of each hasp such that when the hasp plate portions of the first and second hasps are arranged in generally coextensive relation relative to each other, the shackle of the lock is permitted to pass therethrough so as to secure the hasps to each other and thereby maintain-the door in the closed position.

According to this aspect, the shackle guard of each hasp projects beyond the predetermined height of the hasp portion and defines a third opening. The third opening in the shackle guard is arranged in spaced vertical relation from a marginal edge of the hasp portion and accommodates a security seal passing therethrough. The security seal provides an instant visual image whether either door has been moved from their closed position.

Preferably, each hasp portion has a keyhole configuration providing for rotation of the shackle of the lock relative to the hasp. In a preferred embodiment, the elongated and closed marginal openings in the hasp portion of each hasp and the elongated and closed marginal openings in the shackle guard are substantially similar in configuration relative to each other. The third opening defined by the shackle guard preferably has a vertically elongated configuration. In one form, the marginal edge of the third opening defined by the shackle guard has an inner diameter smaller than the inner diameter of the keyhole configuration of the openings defined by either the hasp portion or the shackle guard.

According to yet another aspect, there is provided a lock-protecting hasp apparatus for maintaining first and second container doors in secured relationship relative to each other. Each door is movable from a closed position to an open position. Each door further has a bar lock assembly mounted thereon. The bar lock assembly includes a vertically extending rod cooperable with keepers to retain the respective door in the closed position. The rod is mounted to the door by mounting brackets with fasteners extending through a predetermined pattern of mounting holes in the mounting brackets.

According to this aspect, the lock-protecting hasp apparatus includes a pair of complemental hasps including, respectively, a longitudinally elongated portion with a mounting section defining a plurality of bolt holes arranged in the same predetermined pattern as those on the mounting brackets for the bar lock assembly. As such, the fasteners used to secure the bar lock assembly to the door can also be used to secure each hasp to the door. The longitudinally elongated portion of each hasp a predetermined height. Preferably, the longitudinally elongated portion of each hasp also has an angled section connected to and angled slightly relative to the mounting section.

According to this aspect, each hasp further has a hasp portion having generally the same predetermined height as and extending away from an end region of the angled section of the respective hasp. The hasp portions of the pair of hasps are arranged, when the doors are in the closed position, to project generally coextensive relative to each other. The hasp portion of each hasp defines two vertically elongated openings for accepting and accommodating a shackle of a lock.

With this aspect, each hasp further includes a shackle guard secured to and extending generally coextensive with the hasp portion of each hasp. Each shackle guard defines two openings which are aligned with the two openings in the hasp portion of each hasp such that when the hasp plate portions of the first and second hasps are arranged in generally coextensive relation relative to each other, the shackle of the lock is permitted to pass therethrough and secure the hasps to each other thereby maintaining the doors in their closed position.

The shackle guard of each hasp projects beyond the predetermined height of the hasp portion and defines a third opening. The third opening defined by the shackle guard is arranged in spaced vertical relation from a marginal edge of the hasp mounting portion to accommodate a security seal passing therethrough. The security seal yields an instant visual image whether either door has been moved from the closed position.

In one form, each hasp portion has a keyhole configuration providing for rotation of the shackle of the lock relative to the hasp. Preferably, the elongated and closed marginal openings in the hasp portion of each hasp and the elongated and closed marginal openings in the shackle guard are substantially similar in configuration relative to each other. The third opening defined by the shackle guard has a vertically elongated configuration. In a preferred form, the marginal edge of the third opening defined by the shackle guard has an inner diameter smaller than the keyhole configuration of the openings defined by either the hasp portion or the shackle guard.

DETAILED DESCRIPTION

Figure 1:
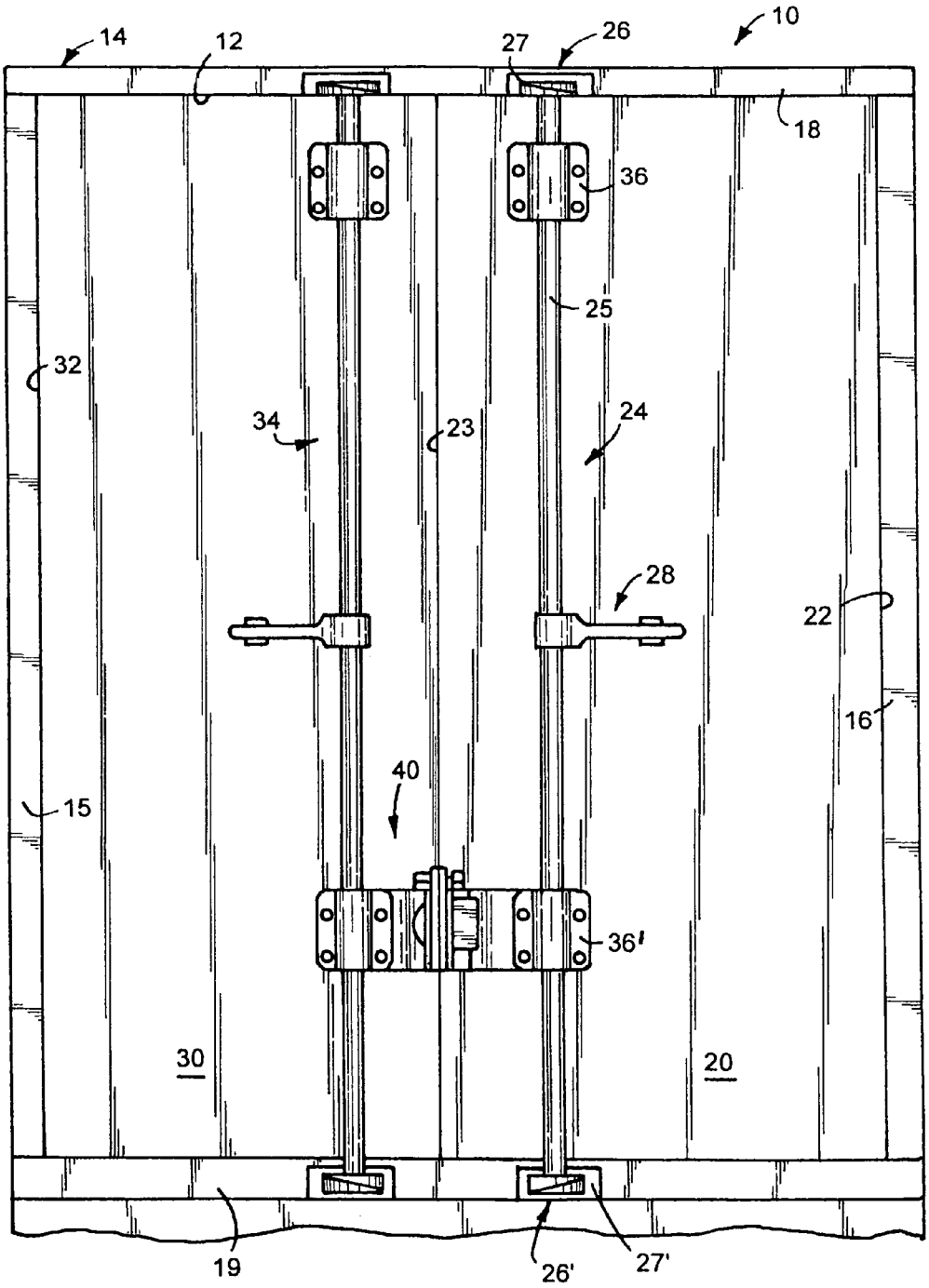
FIG. 1 is a rear view of a container having a lock-protecting hasp apparatus mounted to two opposing doors of the container.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiment illustrated and described.

Referring now to the drawings, wherein like reference numerals indicate like parts throughout the several views, in FIG. 1 there is shown a non-limiting example of a conventional intermodal cargo or freight container, indicated generally by reference numeral 10, having a lock-protecting hasp apparatus according to the present invention disclosure mounted thereon. At one end, container 10 defines a cargo storage opening 12 for permitting access to an interior of the container 10. A frame 14, comprised of a series of rigid frame members including a pair of laterally spaced side members 15 and 16 rigidly joined to a horizontal header 18 and a horizontal sill 19, surrounds the opening 12. In the illustrated example, access to the interior of the cargo container can be provided by a pair of conventional side-by-side swing-out doors 20 and 30. It should be appreciated, however, the lock-protecting hasp apparatus disclosed herein is equally applicable to cargo containers having one or more doors mounted elsewhere on the container 10.

As shown in FIG. 1, door 20 is preferably supported and hingedly connected adjacent one vertical edge 22 to frame 14 whereby allowing door 20 to swingably move between open and closed positions. Similarly, and as shown in FIG. 1, door 30 is preferably supported and hingedly connected adjacent one vertical edge 32 to frame 14 whereby allowing door 30 to swingably move between open and closed positions. In the illustrated example, and when closed, vertical edge 23 of door 20 overlaps the adjacent vertical edge of door 30 at their juncture. As typical, and about the edges thereof, each door 20, 30 can furthermore be provided with compressible seal structure (not shown) formed from rubber or the like for inhibiting debris and moisture from passing between the closed door and the frame 14 on the container 10.

In the example illustrated in FIG. 1, each door 20 and 30 is furthermore provided with a conventional bar lock assembly 24 and 34, respectively, for releasably locking the doors in a closed position. Each conventional bar lock assembly 24, 34 can take any of a myriad of designs without detracting or departing from the spirit and scope of this invention disclosure.

Preferably, and to reduce costs, the bar lock assemblies 24, 34 associated with doors 20, 30, respectively, are substantially identical to each other and, thus, only bar lock assembly 24 will be described. Each bar lock assembly includes an elongated vertically disposed rod 25 mounted adjacent the vertical door edge disposed closet to the vertical door edge of the adjacent door. Toward the upper and lower ends thereof, rod 25 is provided with suitable locking cam structure 26 and 26', respectively, which cooperate with keepers 27 and 27', respectively, on frame 14 for maintaining the doors in their closed position. The locking rod 25 is rotated and the locking cams 26, 26' are operated by a handle 28 secured along the length of rod 25. Handle 28 can be locked, for example by a padlock, to preclude rotation of the locking rod 25. It will be appreciated, however, this handle lock can be and frequently is readily broken by a prybar, lever or bolt cutters whereby unauthorized access the container can be and is easily obtained.

Figure 2:
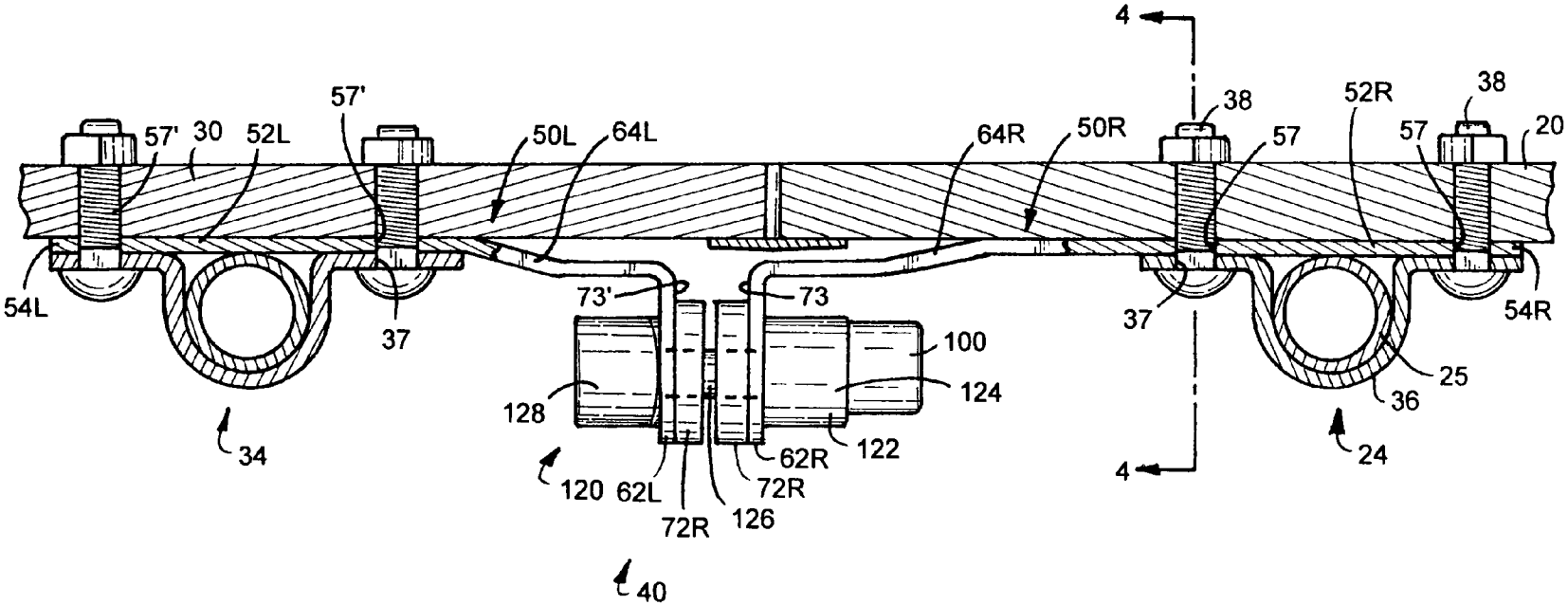
FIG. 2 is an enlarged top plan view, partly in section, of the lock-protecting hasp apparatus illustrated in FIG. 1.

The locking rod 25 of each bar lock assembly 24, 34 is mounted for rotation about a fixed axis to the respective door 20, 30, respectively, by upper and lower mounting brackets 36 and 36'. Besides mounting each locking rod 25 for rotation about a fixed axis relative to the respective door, and as is known, the mounting brackets 36, 36' are preferably designed to limit endwise displacement of the locking rod 25 relative to the respective door. The mounting brackets 36 and 36' for each bar lock assembly are basically of a similar design to each other and, thus only bracket 36 will be discussed. As shown in FIG. 2, each bar lock assembly mounting bracket is provided with a series of mounting holes 37 arranged in a predetermined pattern relative to each other. A plurality of conventional fasteners 38, such as carriage bolts or the like, pass through the mounting holes 37 and securely fasten the mounting brackets to the door.

Figure 3:
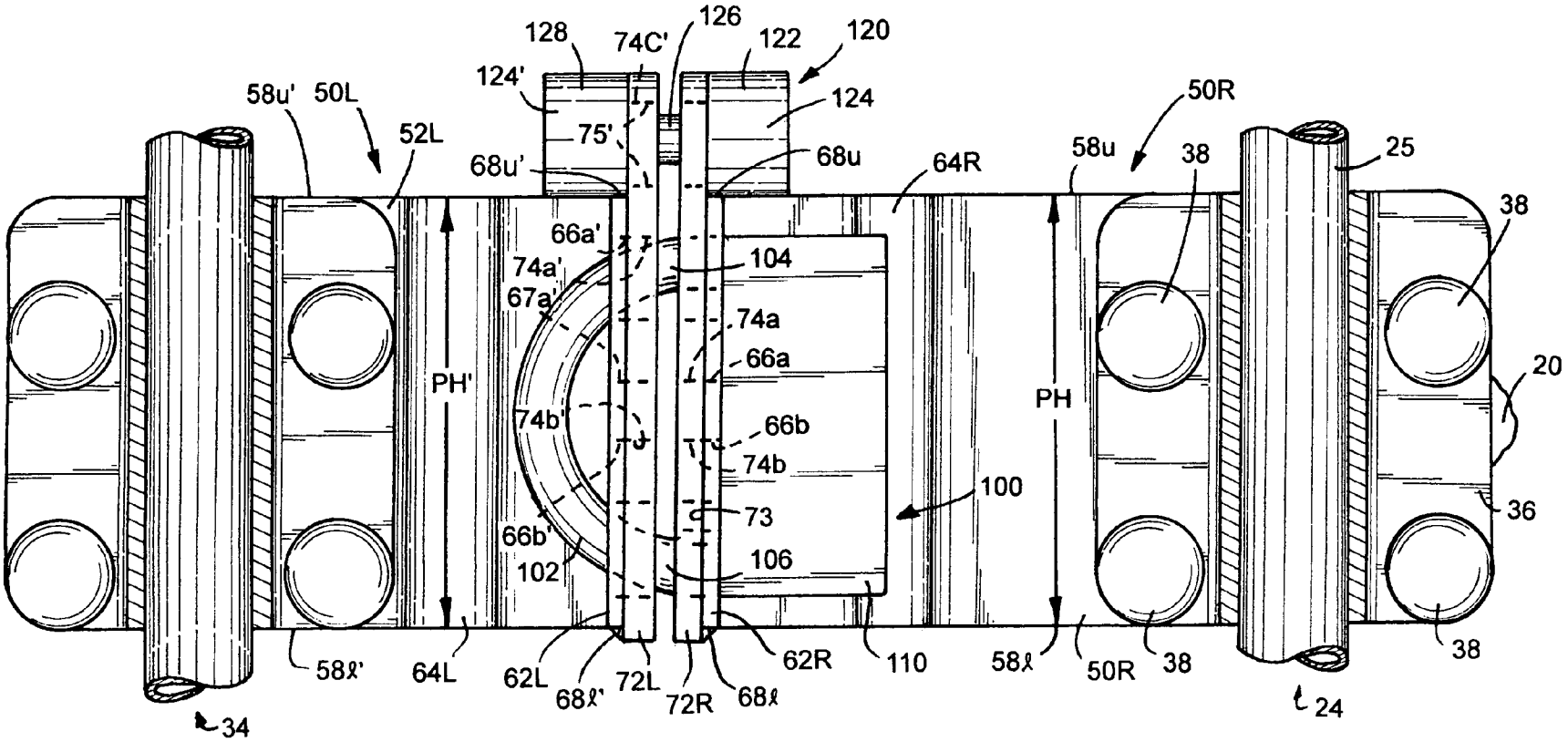
FIG. 3 is a front view of the lock-protecting hasp apparatus illustrated in FIG. 2.

In accordance with the present invention disclosure, there is provided a lock-protecting hasp apparatus, generally indicated in FIG. 1 by reference numeral 40, for maintaining the container doors 20, 30 in secured relationship with each other and so as to limit unauthorized entry into the container 10. Hasp apparatus 40 includes first and second complemental hasps 50R and 50L mounted to an exterior surface of doors 20 and 30, respectively, in generally laterally aligned relation relative to each other. In the form shown in FIGS. 2 and 3, the hasps 50R and 50L are mirror images of each other. When the doors 20 and 30 are in a closed position, the hasps 50L and 50R are designed and arranged to receive a shackle lock, generally indicated by reference numeral 100. As is typical, the shackle lock 100 includes a shackle 102 having a pair of interconnected legs 104 and 106 (FIG. 3). Moreover, and when the doors 20 and 30 are in a closed position, the hasps 50L and 50R are designed and arranged to accommodate a conventional security seal, generally indicated by reference numeral 120.

In the embodiment illustrated in FIGS. 2 and 3, the lock-protecting hasp 50R is secured to door 20 and includes a longitudinally elongated mounting portion 52R having a generally flat mounting section 54R. As shown in FIG. 2, the mounting section 54R of hasp 50R defines a plurality of bolt holes 57. In a preferred form, the bolt holes 57 in the mounting section 54R of hasp 50R are arranged in the same predetermined pattern as the mounting holes 37 in the mounting bracket 36 of each bar lock assembly 24 and 34. As such, the same fasteners 38 can advantageously be used to secure both the hasp 50R and the mounting bracket 36 for each bar lock assembly to the exterior of the door 20.

In the embodiment shown in FIG. 3, the mounting portion 52R of hasp 50R has upper and lower generally parallel marginal edges 58*u* and 58*l* defining a predetermined height PH for the hasp mounting portion 54R of 50R. Hasp 50R furthermore includes a hasp portion 62R connected to and extending away in a direction generally normal to the mounting portion 52R and generally perpendicular to the exterior of the door 20. Preferably, the mounting portion 52R and hasp portion 62R of hasp 50R are formed integral relative to each other. In one form, the mounting portion 52R and hasp portion 62R of hasp 50R are formed from steel which has a generally constant thickness ranging between about 0.125 inches and about 0.187 inches. In the embodiment illustrated in FIG. 4, the hasp portion 62R has upper and lower generally parallel marginal edges 68*u* and 68*l*, respectively, which define a predetermined height PH' of the hasp portion 62R and, in one form, are generally coextensive with the upper and lower generally parallel marginal edges 58*u* and 58*l* of the mounting portion 52R of hasp 50R.

In a preferred form, an angled section 64R extends between the mounting section 54R of hasp 50R and is connected to the hasp portion 62R. More specifically, the angled section 64R of hasp 50R is connected to and angled slightly relative to the mounting section 54R of hasp 50R. In the illustrated embodiment, the hasp portion 62R extends away and generally normal to an end region of the angled section 64R of hasp 50R.

Figure 4:
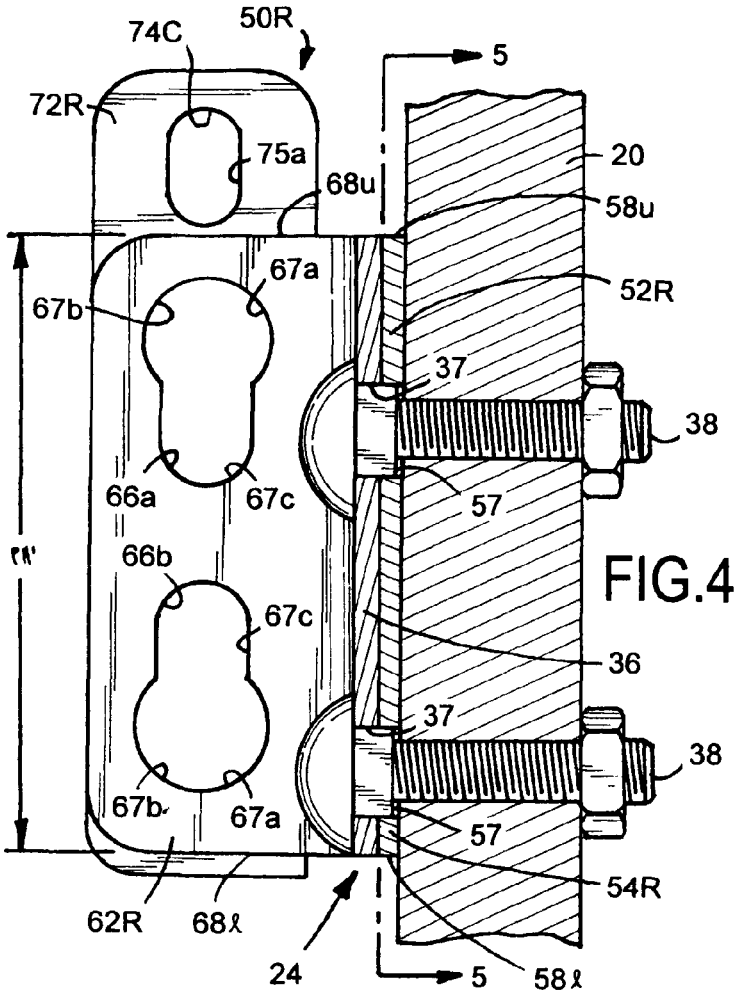
FIG. 4 is an enlarged sectional view taken along line 4-4 of FIG. 2.

Turning now to FIG. 4, the hasp portion 62R of hasp 50R defines two vertically elongated and, in the illustrated embodiment, vertically aligned shackle openings 66*a* and 66*b* for accommodating the legs 104 and 106 of shackle lock 100 (FIG. 3). The vertical elongation of the openings 66*a* and 66*b* permits racking of the doors 20, 30 as the container 10 moves between locations. In the preferred embodiment, each opening 66*a*, 66*b* has a closed marginal edge 67*a* providing a keyhole configuration between opposed ends thereof. That is, a first portion 67*b* of the closed marginal edge 67*a* of each opening 66*a*, 66*b* preferably has a larger diameter than does a second vertically elongated portion 67*c* of the closed marginal edge 67*a* of each opening 66*a*, 66*b*. As shown in FIG. 4, the narrowed vertically elongated portions 67*c* of openings 66*a* and 66*b* are arranged in vertically confronting relation relative to each other and with the larger diameter portion 67*b* being arranged toward opposed ends of the openings 66*a* and 66*b*. Albeit closed, the marginal edge 67*a* of each opening 66*a*, 66*b* permits rotation of the respective shackle leg passing endwise therethrough.

Hasp 50R is furthermore provided with a longitudinally elongated shackle guard 72R which is integrally secured to and extends coextensive with the hasp portion 62R of hasp 50R. In one form, the elongated shackle guard 72R is formed from steel plate or other like material having a generally constant thickness ranging between about 0.153 inches and about 0.250 inches. Preferably, the elongated shackle guard 72R is integrally secured as by welding or the like along the marginal edges of the hasp portion 62R of hasp 50R. Notably, and in the preferred embodiment shown in FIGS. 2 and 3, the shackle guard 72R is secured to that side or surface 73 of shackle guard 72R disposed the furthest distance from the mounting portion 52R of hasp 50R.

Like hasp portion 62R, the shackle guard 72R defines fourth and fifth vertically elongated and, in the illustrated embodiment, vertically aligned, openings 74*a* and 74*b* for accommodating the legs 104 and 106 of shackle lock 100 (FIG. 3). The vertical elongation of the two openings 74*a* and 74*b* permits racking of the doors 20, 30 as the container 10 moves between locations. In the preferred embodiment, each opening 74*a*, 74*b* has a closed marginal edge having a keyhole configuration substantially similar to the keyhole configuration of the openings 66*a*, 66*b* in the hasp portion 62R of hasp 50R. Albeit closed, the closed marginal edge of each opening 74*a*, 74*b* permits rotation of the respective shackle leg passing endwise therethrough.

The shackle guard 72R is preferably configured to vertically extend beyond the predetermined height PH' of the hasp portion 62R of hasp 50R. In the illustrated embodiment, and for purposes described below, shackle guard 72R is configured to vertically extend beyond at least one of the marginal edges 68*u* and 68*l* of the hasp portion 62R of hasp 50R. Preferably, a lengthwise portion of shackle guard 72R is configured to vertically extend beyond the upper marginal edge 68*u* of the hasp' portion 62R of hasp 50R.

As shown in FIG. 4, that lengthwise portion of the shackle guard 72R extending vertically beyond the predetermined height PH' of the hasp portion 62R of hasp 50R defines a third opening 74*c* arranged in vertically spaced relation from a marginal edge of the hasp portion 62R of hasp 50R. As further illustrated in FIG. 4. the third opening 74*c* defined by the shackle guard 72R is generally vertically aligned with and relative to the openings 66*a* and 66*b* defined by the hasp portion 62R of hasp 52R. Preferably, and for purposes described below, the third opening 74*c* defined by the shackle guard 72R of hasp 50R has a closed marginal edge 75*a*. In one form, the marginal edge 75*a* of the third opening 74*c* has a vertically elongated configuration between opposed ends thereof. In a preferred form, the marginal edge 75*a* of the third opening 74*c* defined by the shackle guard 72R has an inner lateral diameter which is smaller than the lateral diameter defined by either the closed marginal edge 67*a* or 67*b* of the openings 66*a* and 66*b*, respectively, defined by the hasp portion 62R of hasp 50R.

Returning to FIG. 2, hasp 50L is secured to door 30 and includes a longitudinally elongated mounting portion 52L with a generally flat mounting section 54L. As shown in FIG. 2, the mounting section 52L of hasp 50L defines a plurality of bolt holes 57'. In a preferred form, the bolt holes 57' in the mounting section 54L of hasp 50L are arranged in the same predetermined pattern as the mounting holes 37 in the mounting bracket of the respective bar lock assembly. As such, the same fasteners can advantageously be used to secure both hasp 50L and the mounting bracket for bar lock assembly 34 to the exterior of door 30.

Like hasp 50R, and as shown in FIG. 3, the mounting portion 52L of hasp 50L preferably has upper and lower generally parallel marginal edges 58*u*' and 58*l*' defining a predetermined height PH for hasp 50L. Preferably, the predetermined height PH' for hasp 50L is substantially equal to the predetermined height PH of hasp 50R. Returning to FIG. 3, and like hasp 50R, hasp 50L furthermore includes a hasp portion 62L connected to and extending away and generally normal to the mounting portion 52L and generally perpendicular to the exterior of the door 30. Preferably, the mounting portion 52L and hasp portion 62L of hasp 50L are formed integral relative to each other. In one form, the mounting portion 52L and hasp portion 62L of hasp 50L are formed from steel having a generally constant thickness ranging between about 0.125 inches and about 0.187 inches. In the embodiment illustrated in FIG. 3, the hasp portion 62L has upper and lower generally parallel marginal edges 68*u*' and 68*l*'. In one form, the predetermined height of the hasp portion 62L of hasp 50L is generally equal to the predetermined height PH of the hasp portion 62R of hasp 50R. In one form, the predetermined height of the hasp portion 62L of hasp 50L is generally equal the distance separating the upper and lower generally parallel marginal edges 58*u*' and 58*l*' of the mounting portion 52L of hasp 50L.

Preferably, an angled section 64L extends between the mounting section 54L of hasp 50L and is connected to the hasp portion 62L. More specifically, the angled section 64L of hasp 50L is connected to and angled slightly relative to the mounting section 54L. In the embodiment shown, the hasp portion 62L extends away and generally normal to an end region of the angled section 64L of hasp 50L.

Turning now to FIG. 4, the hasp portion 62L of hasp 50L defines two vertically elongated and, in the illustrated embodiment, vertically aligned shackle openings 66*a*' and 66*b*' for accommodating the legs 104 and 106 of shackle lock 100. The vertical elongation of the openings 66*a*' and 66*b*' permits racking of the doors 20, 30 as the container 10 moves between locations. In the preferred embodiment, each opening 66*a*', 66*b*' in the hasp portion 62L has a closed marginal edge 67*a*' providing a keyhole configuration between opposed ends thereof. Suffice it to say, the preferred keyhole configuration defined by the marginal edge 67*a*' of the openings 66*a*' and 66*b*' in hasp portion 62L substantially correspond with the preferred keyhole configuration defined by the marginal edge 67*a* of the openings 66*a* and 66*b* in the hasp portion 62R and as shown in FIG. 4. Albeit closed, the marginal edge 67*a*' of each opening 66*a*' and 66*b*' permits rotation of the respective leg of the shackle lock passing endwise therethrough.

Hasp 50L is furthermore provided with a longitudinally elongated shackle guard 72L which is integrally secured to and extends coextensive with the hasp portion 62L of hasp 60L. In one form, the elongated shackle guard 72L is formed from steel plate or other like material having a generally constant thickness ranging between about 0.153 inches and about 0.250 inches. Preferably, the elongated shackle guard 72L is integrally secured as by welding or the like along the marginal edges of the hasp portion 62L of hasp 60L. In the preferred embodiment shown in FIG. 2, the shackle guard 72L is secured to that side or surface 73' of shackle guard 72L disposed the furthest distance from the mounting portion 52L of hasp 50L and such that the shackle guards 72R and 72L are disposed in proximate and confronting relation relative to each other when the doors 20, 30, respectively, are arranged in the closed position.

As shown in FIG. 3, shackle guard 72L defines fourth and fifth vertically elongated and, in the illustrated embodiment, vertically aligned, shackle openings 74*a*' and 74*b*' for accommodating the legs 104 and 106 of lock 100. The vertical elongation of the openings 74*a*' and 74*b*' permits racking of the doors 20, 30 as the container 10 moves between locations. In the preferred embodiment, each opening 74*a*', 74*b*' has a closed marginal edge preferably having a keyhole configuration substantially similar to the preferred keyhole configuration of the openings 74*a*, 74*b* in the hasp portion 62R of hasp 50R. Albeit closed, the closed marginal edge of each opening 74*a*', 74*b*' permits rotation of the respective shackle leg passing endwise therethrough. Moreover, the overriding of at least a portion of the holes in the hasp portions 62L and 62R along with the overriding of at least a corresponding portion of the holes in the shackle guards 72L and 72R facilitates locating and passage of the end of the leg 104/106 of shackle lock 100 into and through portions the hasps 50L and 50R after the doors 20, 30 (FIG. 1) of container 10 are closed Notably, the shackle guard 72L is configured to vertically extend beyond the predetermined height of the hasp portion 62L of hasp 50L. In the illustrated embodiment, and for purposes described below, the guard 72L is configured to vertically extend beyond at least one of the upper and lower generally parallel marginal edges 68*u* ' and 68*l*' of the hasp portion 62L of hasp 50L. Preferably, a lengthwise portion of shackle guard 72L is configured to vertically extend beyond the upper marginal edge 68*u* ' of the hasp portion 62L of hasp 50L.

As shown in FIG. 3, the lengthwise portion of the guard 72L extending vertically beyond the predetermined height of the hasp portion 72L of hasp 50L defines a third opening 74*c*' preferably arranged in vertically spaced relation from a marginal edge of the hasp portion 72L of hasp 50L. As further illustrated in FIG. 4. the third opening 74*c*' defined by the shackle guard 72L is generally vertically aligned with and relative to the openings 66*a* and 66*b* defined by the hasp portion 62L of hasp 50L. Preferably, and for purposes described below, the third opening 74*c*' defined by the shackle guard 72L of hasp 50L has a closed marginal edge 75'. In one form, the marginal edge 75' of the third opening 74*c*' has a vertically elongated configuration between opposed ends thereof. In one form, the marginal edge 75' of the third opening 74*c*' defined by the shackle guard 72L is substantially similar to the marginal edge 75 of the opening 74*c* defined by the shackle guard 72R and as shown in FIG. 4.

It is advantageous to limit the lateral spacing between the shackle guard 72R and 72L of hasps 50R and 50L, respectively, so as to inhibit a pry bar or cutting tool from being inserted between the guards 72R and 72L to sever or otherwise cut or lessen the operable effectiveness of lock 100 in limiting unauthorized access to the interior of container (FIG. 1) as through the doors 20, 30. In this regard, at least one of the mounting sections of hasp 50R or 50L is designed to allow for the lateral spacing between the guards 72R and 72L to be adjusted as required for proper operation of the doors 20, 30.

Figure 5:
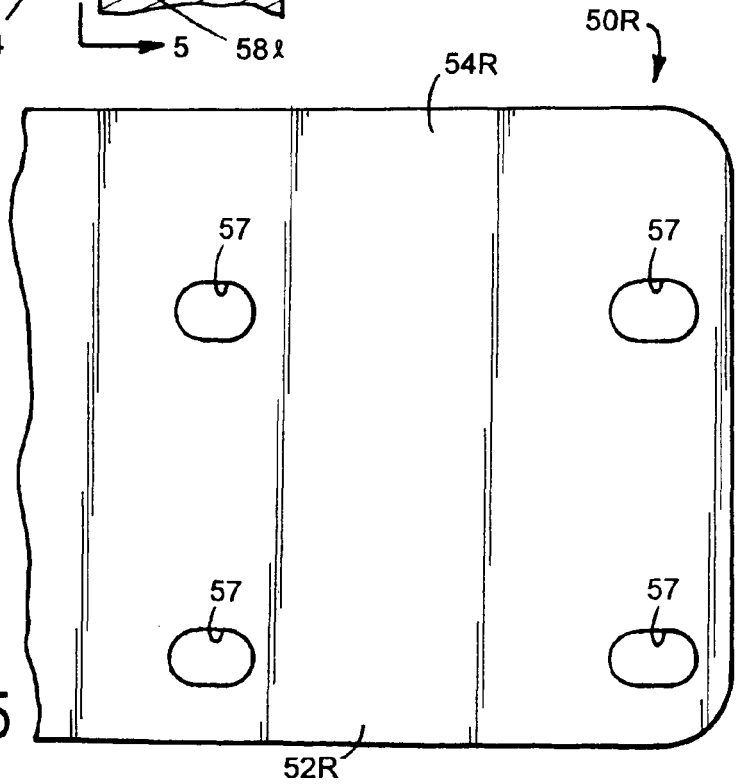
FIG. 5 is a fragmentary view of a mounting portion of one hasp taken along line 5-5 of FIG. 4.

In the form shown in FIG. 5, each opening 57 in mounting section 54 of hasp 50R has a laterally elongated configuration between opposed ends thereof. As shown in FIG. 4, and while accommodating the fasteners 38 used to secure the mounting bracket 36 bar lock assembly 24 to door 20 (FIG. 1), the lateral elongation of the openings 57 (FIG. 5) permits hasp 50R to be laterally shifted within predetermined limits relative to hasp 50L (FIG. 3) whereby allowing the spacing between confronting surfaces on the shackle guards 72R and 72L (FIG. 3) to be laterally adjusted, as required, relative to each other whereby minimizing the lateral space there between.

In operation, one end of each leg 104/106 of the open shackle 102 is inserted through one the openings in the hasp portion 62L and shackle guard 72L of hasp 50L and through the openings in the shackle guard 72R and hasp portion 62R of hasp 50R until the legs 104/106 are arranged in secured relation with the lock body 110 (FIG. 3) of lock 100. Of course, the direction of inserting the ends of the legs 104, 106 of shackle 102 through the hasps 50R and 50L can be reversed from that described without detracting or departing from the true spirit and novel scope of this invention disclosure. Having secured the ends of legs 104, 106 relative to the lock body 110, the doors 20, 30 of container 10 are secured to each other whereby inhibiting access to the interior of container 10.

While providing a detriment to access to the interior of the container 10, lock 100 can be manipulated and arranged such that it readily fails to provide an instant visual image of whether the doors 20, 30 of container 10 have been moved from the closed position after the lock 100 is secured and locked. Accordingly, security seal 120 is provided in combination with the hasps 50R and 50L to yield an instant visual image of whether the doors 20, 30 of container 10 have been moved from the closed position after the lock 100 is secured and locked.

The security seal 120 can be of any conventional design without detracting or departing from the spirit and scope of this invention disclosure. In the form illustrated by way of example in FIGS. 2 and 3, the security seal 120 includes a first member 122 having an enlarged head portion 124 and an elongated shank portion 126 extending from and secured to head portion 124. A second member 128 of security seal 120 defines an enlarged head portion 124' with suitable instrumentalities (not shown) for endwise receiving, accommodating and securing a free end of the elongated shank portion 126 of the first member 122 securely therewithin and in a manner inhibiting inadvertent separation of the lock member 122 and 128 relative to each other.

As shown in FIGS. 2 and 3, the shank portion 126 of the security seal 120 is deigned and configured to slide endwise through the closed margin of openings 74*c* and 74*c*' in the shackle guard 72R and 72L of each hasp 50R and 50L, respectively. Of course, the head portions 124, 124' of the first and second members 122 and 128 of the security seal 120 are purposefully sized to inhibit their passage through the openings 74*c* and 74*c*' in the shackle guard 72R and 72L of each hasp 50R and 50L, respectively. Moreover, the vertical elongation of the openings 74*c* and 74*c*' in the shackle guards 72R and 72L, respectively, allows relative vertical displacement or racking of the doors 20, 30 as container 10 is moved between locations without adversely affecting performance of the security seal 120. It should be appreciated, the design of the shackle guards 72R and 72L on each hasp 50R and 50L readily lends itself to security seals having different designs from that shown merely for exemplary purposes.

The security seal 120 furthermore adds to the inability to gain unauthorized access to the container 10 through the doors 20, 30. Of course, if and when the doors 20, 30 of container 10 are unauthoritatively moved from their closed position, the security seal 120 will break as through separation of the first and second members 122 and 128 relative to each other whereby yielding an instant visual image of whether the doors 20, 30 of container 10 have been moved from the closed position after the lock 100 is secured and locked. In this regard, the hasps 50R and 50L are preferably designed such that the security seal 120 is purposefully disposed to pass through the shackle guards 72R and 72L toward an upper side of the hasps 50R and 50L such that the security seal 120 is more readily viewable at merely a quick glance from a rear side of the container 10 whereby facilitating the ability to quickly and readily appreciate when the doors 20, 30 of container 10 have been unauthoritatively moved from their closed position.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A lock-protecting hasp apparatus for use on a container having a first door movable from a closed position to an open position, said lock-protecting hasp apparatus comprising:

a first hasp securable to an exterior surface of said first door, and a second hasp, and with each hasp having a mounting portion and a hasp portion connected to and extending away from the mounting portion of the respective hasp, with the hasp portions of said first and second hasps being arranged, when said door is in the closed position, to project generally coextensive relative to each other, and with the hasp portion of each hasp having upper and lower edges defining a predetermined height of the hasp, and with the hasp portion of each hasp defining two closed marginal openings for accepting and accommodating a shackle of a lock such that when the hasp portions of the hasps are arranged in generally coextensive relation relative to each other, the shackle of the lock is permitted to pass therethrough to secure the hasps to each other and thereby maintain the door in the closed position, and with each hasp further including a shackle guard which is integral and extends generally coextensive with the hasp portion of each hasp such that said shackle guard moves with each hasp, and wherein the shackle guard of each hasp projects beyond the predetermined height of the hasp portion and defines a third opening, arranged in spaced vertical and generally aligned relation with the two openings in the hasp portion of each hasp such that, when the door is in the closed position, the respective shackle guards on the first and second hasps are arranged in confronting relation relative to each other with the third opening defined by each shackle guard being generally aligned relative to each other so as to accommodate a security seal passing therethrough and so as to allow the security seal to provide an instant visual image whether the door has moved from the closed position.

2. The lock-protecting hasp apparatus according to claim 1, wherein a marginal edge of each opening in the hasp portion of each hasp has a keyhole shaped configuration providing for rotation of the shackle of the lock relative to the hasp.

3. The lock-protecting hasp apparatus according to claim 1, wherein each of said shackle guards further defines two additional keyhole shaped openings which align with the two keyhole shaped openings in the hasp portion of each hasp such that when the hasp portions of the hasps are arranged in generally coextensive relation relative to each other the shackle of the lock is permitted to pass therethrough to secure the hasps to each other.

4. The lock-protecting hasp apparatus according to claim 2, wherein a marginal edge of the third opening defined by the shackle guard has a vertically elongated configuration.

5. The lock-protecting hasp apparatus according to claim 4, wherein the marginal edge of the third opening defined by the shackle guard has an inner lateral diameter smaller than a lateral diameter of the keyhole shaped openings defined by either the hasp portion or the shackle guard.

6. The lock-protecting hasp apparatus according to claim 1, wherein said container has a second door cooperable with the first door, with the second hasp being mounted on the second door.

7. A lock-protecting hasp apparatus for maintaining first and second container doors in secured relationship relative to each other, with each door being swingably movable from a closed position to an open position, said lock-protecting hasp comprising:

a pair of complemental hasps including, respectively, a hasp portion with upper and lower marginal edges defining a predetermined height of the hasp portion and with each hasp portion defining first and second openings for receiving a padlock shackle having a pair of interconnected shackle legs and an elongated mounting portion secured to and extending away from the hasp portion for fixedly securing the hasps to the doors in adjacent relation relative to each other such that the hasp portions are arranged in proximate and confronting relation to each other when the doors are in their closed position whereby permitting the padlock shackle to pass through the openings in the hasp portions of the respective hasps so as to lock the doors together, and wherein each hasp further includes a shackle guard which is integral and extends generally coextensive with the hasp portion of each hasp such that the shackle guard of each hasp moves with each hasp when the respective door is moved, and with each shackle guard projecting beyond the predetermined height of the hasp portion and defines a third opening, arranged in spaced vertical and generally aligned relation with the openings in the hasp portion of each hasp, for accommodating a security seal passing therethrough and so as to allow the security seal to provide an instant visual image whether either door has been moved from the closed position.

8. The lock-protecting hasp apparatus according to claim 7, wherein a marginal edge of the first and second openings defined by the hasp portion of each hasp has a keyhole configuration providing for rotation of the shackle of the lock relative to the hasp.

9. The lock-protecting hasp apparatus according to claim 8, wherein the shackle guard of each hasp defines fourth and fifth openings which align with the first and second openings in the hasp portion of each hasp after the shackle guard is integrally secured to the hasp portion of each hasp, and wherein a marginal edge of the first and second openings defined by the hasp portion of each hasp and a marginal edge of the fourth and fifth openings defined by the shackle guard of each hasp are substantially similar in configuration relative to each other.

10. The lock-protecting hasp apparatus according to claim 7, wherein a marginal edge of the third opening defined by the shackle guard of each hasp has a vertically elongated configuration.

11. The lock-protecting hasp apparatus according to claim 10, wherein the marginal edge of the third opening defined by the shackle guard of each hasp has an inner lateral diameter smaller than the inner lateral diameter of the first and second openings defined by the hasp portion or the inner lateral diameter of the fourth and fifth openings defined by the shackle guard.

12. A lock-protecting hasp apparatus for maintaining first and second container doors in secured relationship relative to each other, with each door being swingably movable from a closed position to an open position, said lock protecting hasp apparatus comprising:

a pair of complemental hasps including, respectively, a longitudinally elongated configuration including a mounting section defining a plurality of mounting bolt holes for allowing each hasp to be secured to and movable with one of said container doors, with the mounting section of each hasp having spaced first and second generally parallel marginal edges defining a predetermined height of each hasp, and with the longitudinal configuration of each hasp also having an angled section connected to and angled slightly relative to the mounting section, with each hasp further having a hasp portion with generally the same predetermined height as and extending away from an end region of the angled section of the respective hasp, with the hasp portions of said pair of hasps being arranged, when said doors are in the closed position, to project generally coextensive relative to each other, and with the hasp portion of each hasp defining first and second vertically elongated closed marginal openings for accepting and accommodating a shackle of a lock, and with each hasp further including a shackle guard which is integral and extends generally coextensive with the hasp portion of each hasp such that each shackle guard moves with the respective hasp, with each shackle guard projecting beyond the predetermined height of the hasp portion and defines a third opening with a closed marginal edge, with the third opening defined by each shackle guard being arranged in spaced vertical relation from a marginal edge of the hasp portion and in general vertical alignment with the openings in the has portion of each hasp, for accommodating a security seal passing therethrough so as to allow the security seal to a visual image whether either door has been moved from their closed position.

13. The lock-protecting hasp apparatus according to claim 12, wherein a margin of the first and second openings in the hasp portion of each hasp has a keyhole configuration providing for rotation of the shackle of the lock relative to the hasp.

14. The lock-protecting hasp apparatus according to claim 13, wherein the shackle guard on each hasp defines two additional keyhole shaped openings which generally align with the first and second keyhole shaped openings in the hasp portion of each hasp.

15. The lock-protecting hasp apparatus according to claim 14, wherein a marginal edge of said third opening defined by the shackle guard has a vertically elongated configuration.

16. The lock-protecting hasp apparatus according to claim 15, wherein the marginal edge of the third opening defined by the shackle guard has an inner lateral diameter smaller than the inner lateral diameter of the first and second openings defined by the hasp portion or said additional openings defined by the shackle guard.

17. A lock-protecting hasp apparatus for maintaining first and second container doors in secured relationship relative to each other, with each door being swingably movable from a closed position to an open position, and with each door having a bar lock assembly mounted thereon, with the each bar lock assembly including a vertically extending rod cooperable with keepers to retain the respective door in the closed position, and with the rod being mounted to the door by mounting brackets with fasteners extending through a predetermined pattern of mounting holes in the mounting brackets, with said lock protecting hasp apparatus comprising:

a pair of complemental hasps including, respectively, a longitudinally elongated mounting portion with a mounting section defining a plurality of bolt holes arranged in the same predetermined pattern as those on the mounting brackets for the bar lock assembly such that the same fasteners used to secure the bar lock assembly are used to secure the mounting section of each hasp to one of the container doors, and with the mounting section of each hasp having spaced first and second generally parallel marginal edges defining a predetermined height of each hasp, and with the longitudinally elongated mounting portion of each hasp also having an angled section connected to and angled slightly relative to the mounting section, with each hasp further having a hasp portion with generally the same predetermined height as and extending away from an end region of the angled section of the respective hasp, with the hasp portions of the pair of hasps being arranged, when the doors are in the closed position, to project generally coextensive relative to each other, and with the hasp portion of each hasp defining two elongated openings for accepting and accommodating a shackle of a lock, with each hasp further including a shackle guard which is integral and extends generally coextensive with the hasp portion of each hasp such that said shackle guard moves with each hasp, and with the shackle guard of each hasp projecting beyond the predetermined height of the hasp portion and defines a third opening arranged in spaced vertical and generally aligned relation with the two elongated openings defined by the hasp portion of each hasp so as to accommodate a security seal passing therethrough whereby yielding an instant visual image whether either door has been moved from their closed position.

18. The lock-protecting hasp apparatus according to claim 17, wherein a marginal edge of the two elongated openings defined by the hasp portion of each hasp each has a keyhole configuration providing for rotation of the shackle of the lock relative to the hasp.

19. The lock-protecting hasp apparatus according to claim 17, wherein said shackle guard is integrally secured to the hasp portion of each hasp, with each said shackle guard further defining two additional openings which align with the two elongated openings in the hasp portion of each hasp such that when the hasp portions of the hasps are arranged in generally coextensive relation relative to each other, the shackle of the lock is permitted to pass therethrough to secure the hasps to each other.

20. The lock-protecting hasp apparatus according to claim 17, wherein a marginal edge of the third opening defined by the shackle guard has a vertically elongated configuration.

21. The lock-protecting hasp apparatus according to claim 18, wherein the marginal edge of the third opening defined by the shackle guard has an inner lateral diameter smaller than the inner lateral diameter of the two elongated openings defined by the hasp portion of the respective hasp.

* * * * *